US006902058B1

(12) United States Patent
Chang

(10) Patent No.: US 6,902,058 B1
(45) Date of Patent: Jun. 7, 2005

(54) PRODUCT PACKAGING AND DISPLAYING DEVICE

(76) Inventor: Chia-Ching Chang, No.21, Guancian Rd., Lugang Township, Changhua County 505 (TW)

( * ) Notice: Subject to any disclaimer, the term of this patent is extended or adjusted under 35 U.S.C. 154(b) by 0 days.

(21) Appl. No.: 10/730,821

(22) Filed: Dec. 8, 2003

(51) Int. Cl.[7] ..... B65D 85/28
(52) U.S. Cl. ..... 206/378; 206/493; 206/806; 211/70.6
(58) Field of Search ..... 206/372–378, 206/806, 807, 493, 349; 211/70.6

(56) References Cited

U.S. PATENT DOCUMENTS 6,092,656 A * 7/2000 Ernst ..... 206/378
6,415,933 B1 * 7/2002 Kao ..... 206/378
6,508,360 B1 * 1/2003 Chen ..... 206/378
6,669,032 B2 * 12/2003 Kao ..... 206/378

* cited by examiner

*Primary Examiner*—Luan K. Bui
(74) *Attorney, Agent, or Firm*—Charles E. Baxley

(57) ABSTRACT

The product packaging and displaying device includes a main holding member and a covering member, hanging elements disposed at two opposite sides of the holding member, and a connecting part for connecting the covering member to the holding member, a number of sleeving and covering parts are evenly disposed on one side of the covering member, a hollow connecting board is protruded from the same side of the covering member, the hollow connecting board is engaged onto the connecting part of the holding member for stably displaying products in the displaying device.

8 Claims, 7 Drawing Sheets

PRODUCT PACKAGING AND DISPLAYING DEVICE

BACKGROUND OF THE INVENTION

Generally, sockets are displayed with cardboards and styrofoam for sale. Another way is to place it inside a toolbox and sell it as a set. Traditionally packages and ways of display have high chances of getting the products stolen. Referring to FIG. 1, a prior art comprises a hanging body 71, one end having a protruded locking part 72 for attaching a socket thereto. This can only display one socket at a time and the socket is completely exposed outside. This does not make the product attractive, and if the socket falls accidentally, it will cause damages.

Referring to FIG. 2, illustrated is another prior art which is a hanging device for storing and displaying a socket. It mainly comprises a hanging part 73, its board surface includes a plurality of holes formed therein and a hanging hole formed and located above the holes. The back of the board includes protruded edges, a socket base 74 is hollowed, a protruded edge is disposed on it, a convex dot is disposed at its both sides on the top part, the top part can be inserted into one side of the socket, the bottom end is inserted into the plurality of holes. The bottom end includes an opening, and a protruded edge of upside-down hook shape is disposed by the opening, the protruded edge can hook on the plurality of holes. A positioning piece 75 includes one end in screw head shape, the other end can goes through the socket, the same end includes an opening, a protruded edge of upside-down hook shape is disposed at the same end for hooking on the bottom edge of the socket base. The screw head's height is shorter than the socket. Accordingly, the positioning piece 75 goes through the socket and is fixed by the screw head, and have to cut the upside-down hook liked protruded edge of the positioning piece 75 from the hanging part 73, in order to take out the socket. The plurality of holes of the hanging part 73 can hold several sockets.

Although the above prior art can hold several sockets, too many elements make the costs very high, besides, the fixing and placing of sockets is too complicated and time-wasting. When displaying the socket, the socket base 74 has to be placed in the hole of the hanging part 73, after the socket is placed in the socket base 74, then the socket should be positioned by the positioning piece 75. If it is required to take off the socket, it is required to cut off the upside-down hook shaped protruded edge at one end of the positioning piece 75. Thus it is not convenient to place and take off the socket. It also causes damages if it falls down on the ground.

Referring to FIG. 3, illustrated is another prior art of a socket hanging frame. It mainly comprises a rod liked hanging frame 81 and an U-shaped holding frame 91. The rod liked hanging frame 81 includes a plurality of combining elements 82 vertically disposed on the frame 81. The combining element 82 comprises a pair of corresponding elastic pieces, the first elastic piece protrudes outward as a protruded piece 821. An elastic body 822 is disposed between the two elastic pieces. The hanging frame 81 includes an ear part 83 at each end, the holding frame 91 is fixed on the hanging frame 81 to form a space for placing a socket. The holding frame 91 includes a supporting post 92 at each end protruded toward the hanging frame 81. The supporting post 92 includes an U-shaped supporting frame 911 at its top end. The two ends of the supporting frame 911 can go through the ear part 83 of the hanging frame 81. The supporting frame 91 is fixed on the hanging frame 81. On either longitudinal sides of the bottom of the holding frame 91 includes a wave-shaped protection board 93 disposed toward the hanging frame 81. Each curve part of the protection board 93 is corresponding to the combining element 82 of the hanging frame 81. A positioning board 94 for positioning the socket, is vertically disposed in the middle of each protection board 93 on the bottom of the holding frame 91. A groove 941 between each positioning board 94 and each protection board 93 is for placing the circumference edge of the socket.

The above described three prior arts can display sockets, but all have complicated structures which are high in costs. The effect and quality of display functions that they may provide are not ideal. The drawbacks are:

1. Complicated structures and high costs. Even though the third prior art only comprises a hanging frame and a holding frame, all the elements include the protruded piece, the elastic body, the protection board, the positioning board and the groove for placing the socket, and all the elements include the ear part, the supporting post and the supporting frame for assembling, are indeed complicated, it is not convenient to assemble and also of high costs.
2. Not convenient to assemble. When assembling the hanging frame and the holding frame together, it may have to combine the U-shaped holding frame at one end of the holding frame, to the ear part of the hanging frame, then using a string 84 to engage through the holes of the ear part and the supporting frame. It is ineffective and not stable at all.
3. Due to the limitation of the combining elements and the elements forming the groove, the prior arts can only hold generally sockets. If the sockets have long and short lengths, the hanging frame cannot hold them at the same time. Besides, the holding frame and the hanging frame are fixed by a string which makes it easier to be stolen. If sockets fall down, it will cause damages.

SUMMARY OF THE INVENTION

The present invention is to provide a product packaging and displaying device which can easily and conveniently display and package sockets, and can also prevent sockets from falling off and from causing damages.

The present invention will become more fully understood by reference to the following detailed description thereof when read in conjunction with the attached drawings.

DETAILED DESCRIPTION OF THE PREFERRED EMBODIMENT

Figure 1:
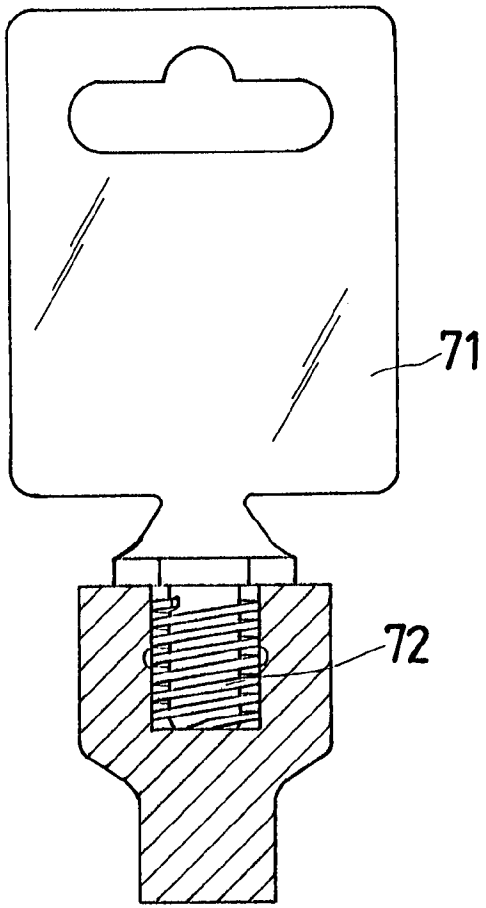
FIG. 1 PRIOR ART
FIG. 1 is a flat view of a socket display frame of a first prior art.
Figure 2:
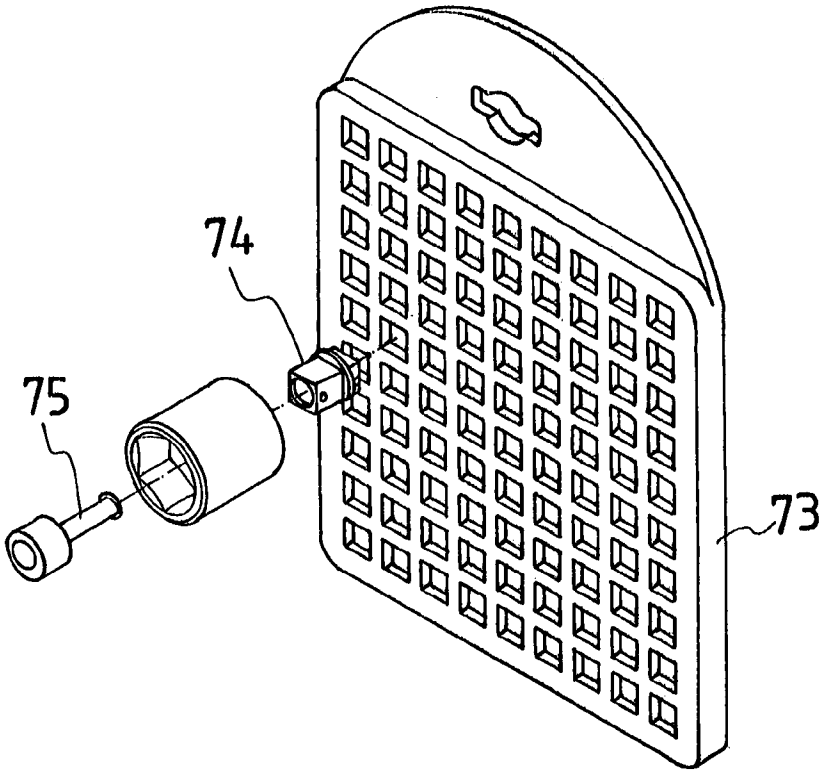
FIG. 2 PRIOR ART
FIG. 2 is an exploded assembly view of a socket display frame of a second prior art.

Referring to FIGS. 4 to 10, the present invention of a product packaging and displaying device is a display device 1, which mainly comprises a holding body 10 and a covering body 20, for packaging and placing display product 30 such as sockets and socket rods.

The holding body 10 includes one side having a protruded board part with holes disposed on it, to form a hanging part 11, another side having a positioning part 12 for one end of the display product 30 to attach thereon, and a connecting part 13 extended from each side for the covering body 20 to connect onto. A hollow display part 14 is protruded outward and disposed between the positioning part 12 and the hanging part 11. The two connecting parts 13 are disposed near the ends of the holding body 10, while the positioning parts 12 are evenly disposed between the two connecting parts 13. The positioning parts 12 are in neighboring to each other and each of them is formed by two parallel pieces. The width of the two parallel pieces equals to the hole diameter of the display product 30. Each parallel piece includes a locking device 121 disposed on the outer side, for pressing against the display product 30. Each of the two connecting parts 13 includes two positioning holes 131 at suitable locations, for attaching the covering body 20. The display part 14 is a protruded part for sticking trademarks or product instructions, its width is just slightly wider than the maximum width of the display product 30, so that the display product 30 can fit onto the display part 14 and within the outer edges of a sleeving and covering part 21.

The covering body 20 is in an upside-down U-shape, which is assembled to one side of the holding body 10 with which the side is for attaching the display product 30. The sleeving and covering parts 21 are evenly disposed and connected to the holding body 10 in corresponding to the positioning parts 12. Structure and shape of each sleeving and covering part 21 can be changed according to the display product 30. In the first, the second, and the third embodiments of the present invention, the sleeving and covering part 21 is a sleeve-ring structure having a hole, for attaching the display product 30. The covering body 20 includes a hollow connecting board 22 protruded outward and disposed on each end. The connecting board 22 includes a locking piece 221 to lock with the positioning hole 131, for fixing the connecting part 13 of the holding body 10.

Accordingly, insert the hole of display product 30 into the positioning part 14, the covering body 20 is fixed on one side of the holding body 10 by the locking mechanism of the connecting board 22 and the connecting part 13, while each sleeving and covering part 21 is attached on the outer surface of the display product 30, so that the display product 30 is placed inside the display device 1 conveniently and stably. The upside-down hook-liked structure of the locking piece 221 can further provide even more stable assembly of the holding body 10 and the covering body 20, which cannot be damaged at a short time to steal the display product 30.

Figure 3:
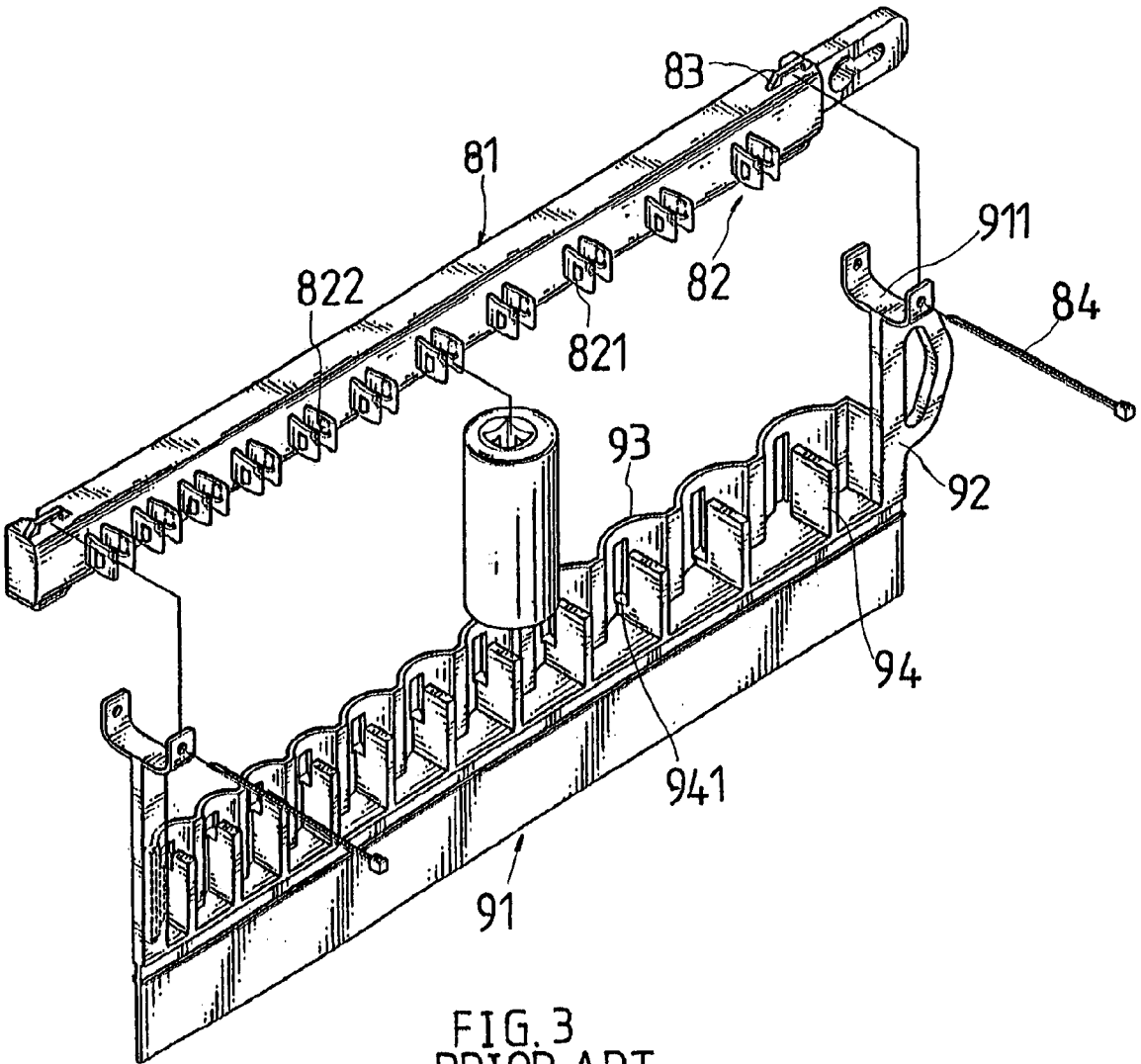
FIG. 3 PRIOR ART
FIG. 3 is an exploded assembly view of a socket display frame of a third prior art.

Besides, the covering body 20 can be in different structures for fitting various display product 30 to achieve excellent packaging function. The display part 14 and the sleeving and covering part 21 include widths bigger than that of the display product 30, as referring to FIG. 3, and can prevent the display product 30 from being damaged when the display device 1 falls off. Thus the present invention is ideal for displaying and packaging display product 30.

Figure 4:
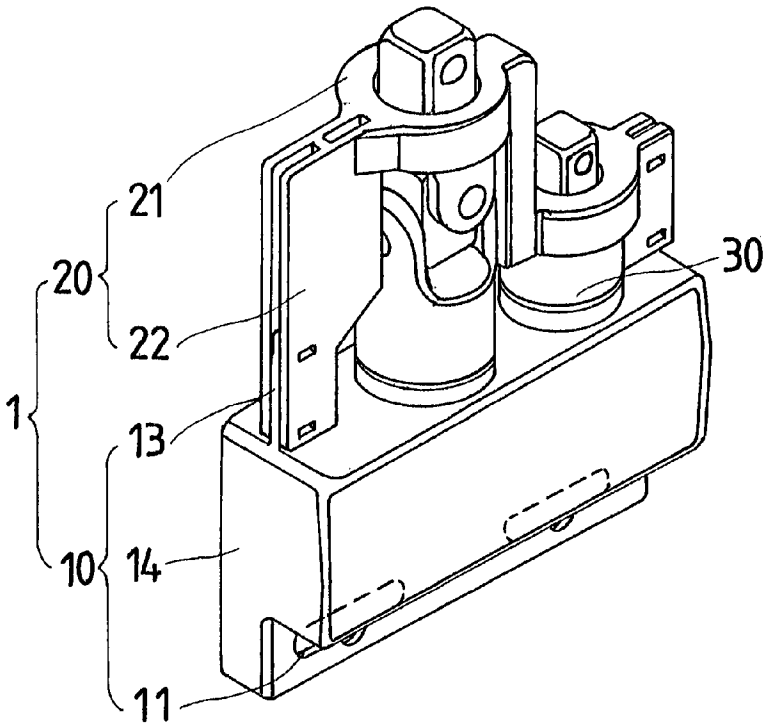
FIG. 4 is a perspective view of a product packaging and displaying device of the present invention.
Figure 5:
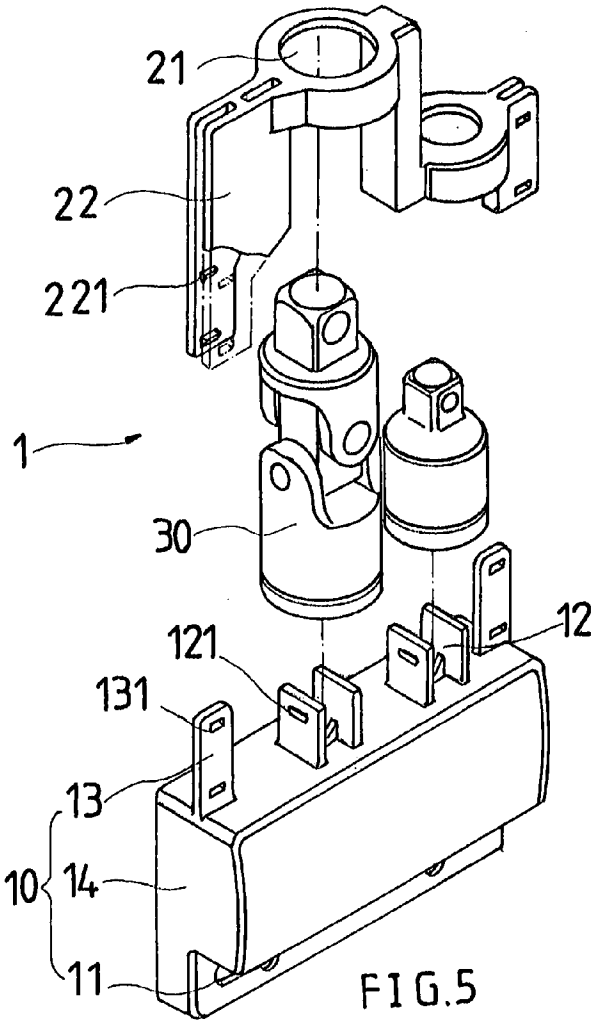
FIG. 5 is an exploded assembly view of a product packaging and displaying device of the present invention.
Figure 6:
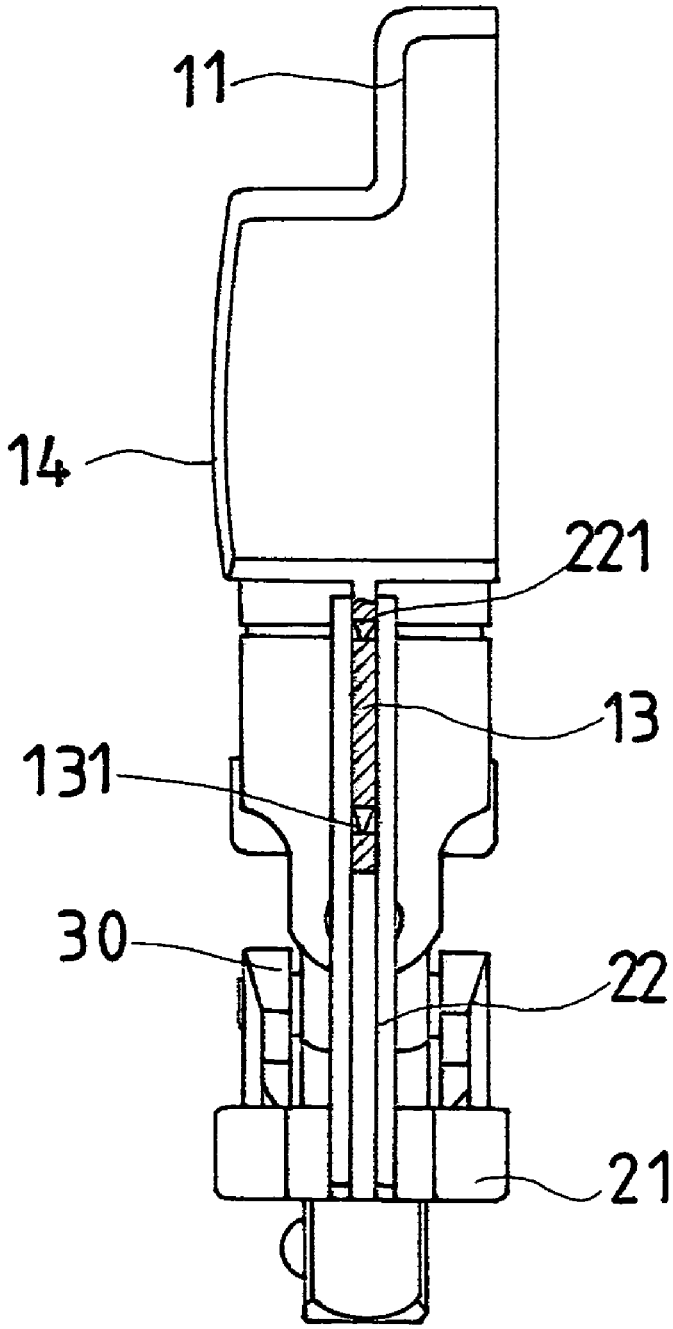
FIG. 6 is a flat view of a product packaging and displaying device of the present invention.
Figure 7:
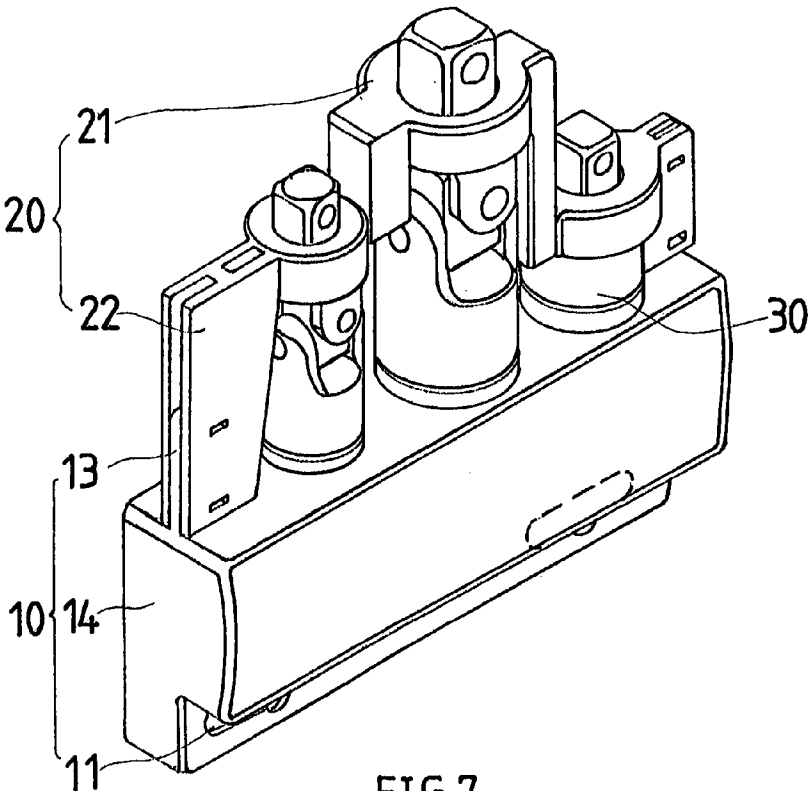
FIG. 7 is a perspective view of a second embodiment of the present invention.
Figure 8:
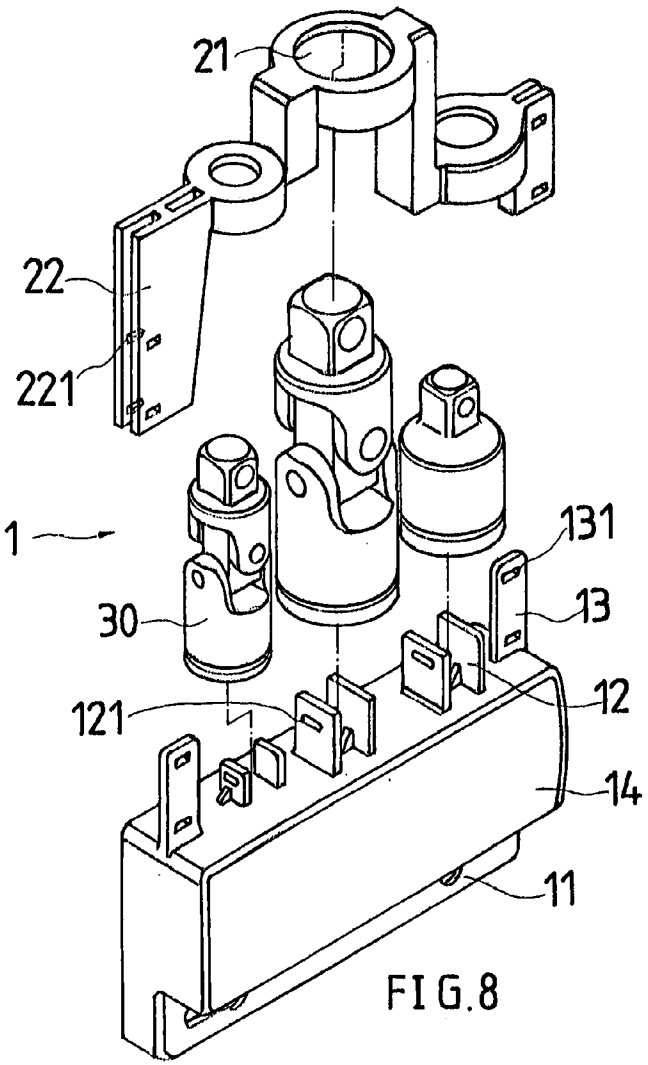
FIG. 8 is an exploded assembly view of the second embodiment of the present invention.
Figure 9:
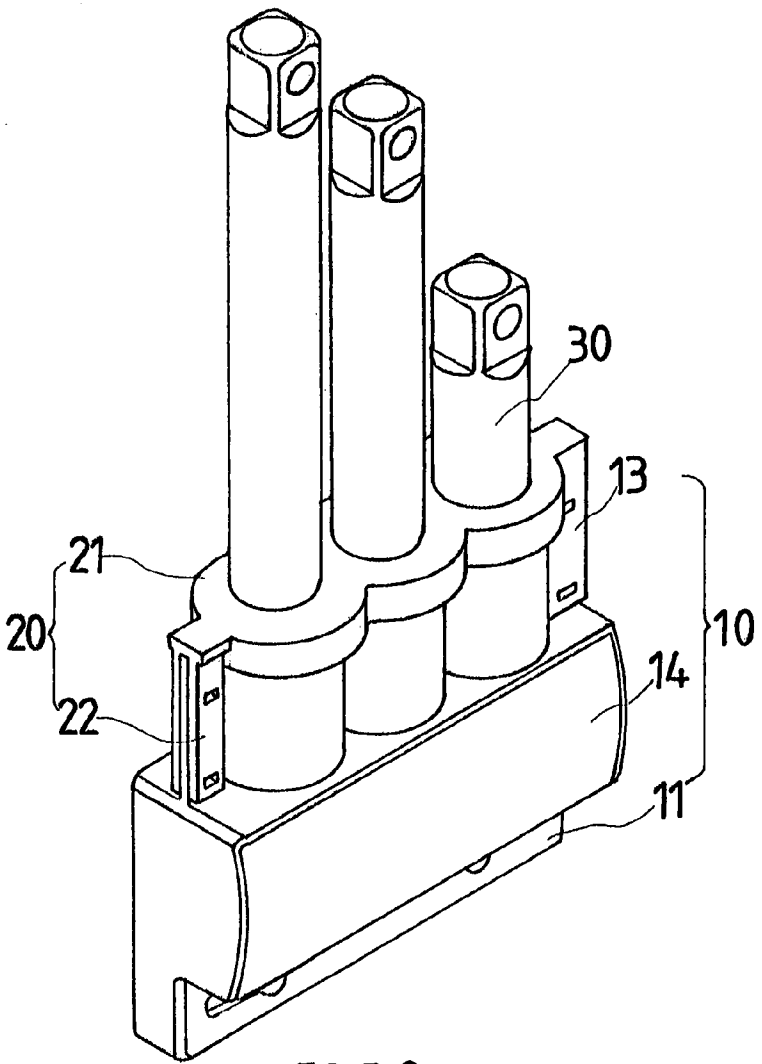
FIG. 9 is a perspective view of a third embodiment of the present invention.
Figure 10:
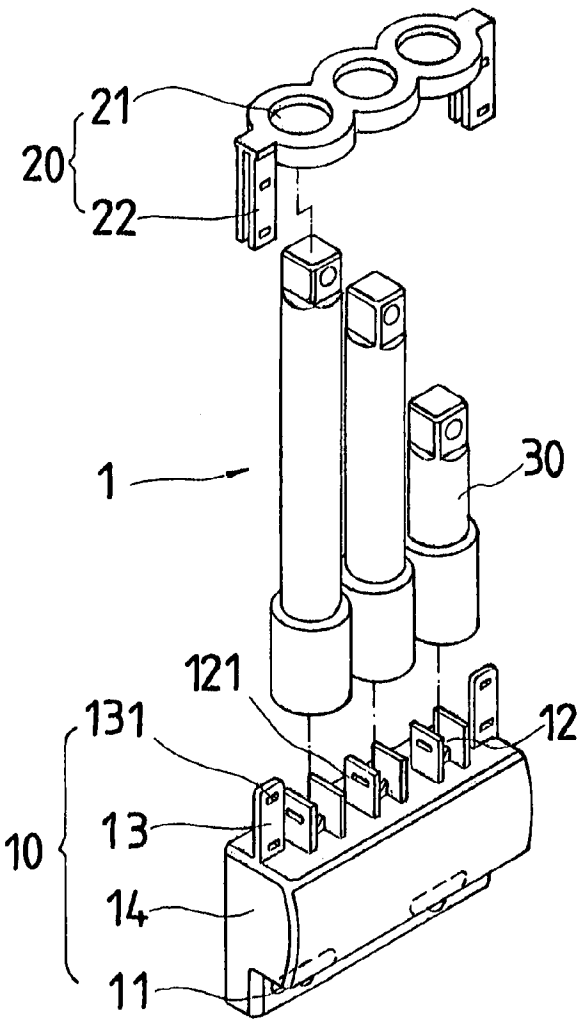
FIG. 10 is an exploded assembly view of the third embodiment of the present invention.

The height and structure of the sleeving and covering part 21 of the covering body 20 can be changed according to the structure, shape and length of the display product 30. Referring to FIGS. 4 and 5, in the first embodiment of the present invention, the covering body 20 is in sectional structure in corresponding to the display product 30 of a socket turning head and a universal socket. Referring to FIGS. 7 and 8, in the second embodiment of the present invention, the covering part 20 is in a structure with both sides shorter than the middle, in corresponding to the display product 30 of a big and a small universal sockets and a socket turning head. Referring to FIGS. 9 and 10, the covering body 20 is in a flat shape, in corresponding to the display product 30 of a long socket rod.

Figure 11:
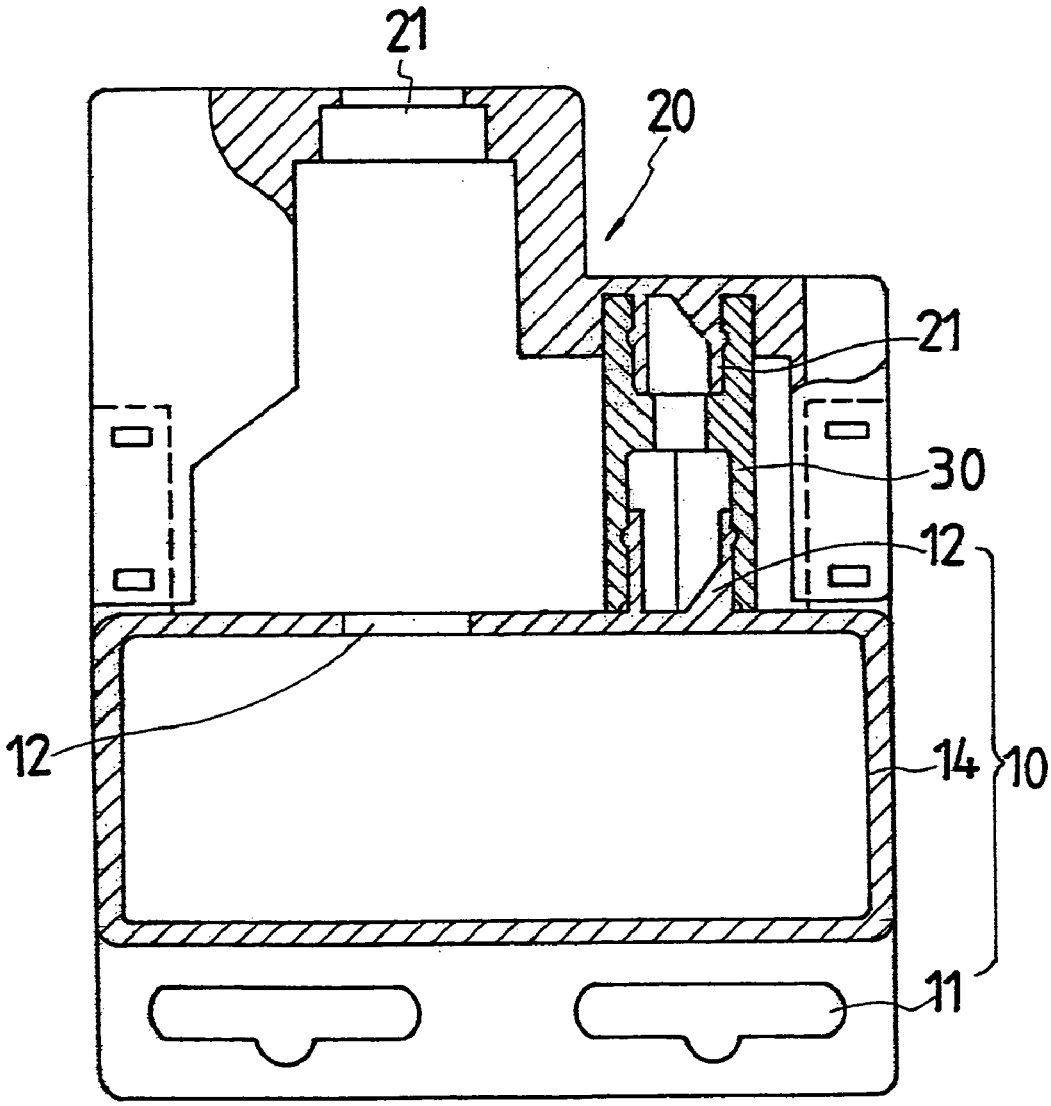
FIG. 11 is a view of another structural application of a sleeving and covering part of a covering body of the second embodiment of the present invention.

Referring to FIG. 11, if the display product 30 includes one end as a hexagonal socket hole, another end as a rectangular socket, then the sleeving and covering part 21 can be formed as the structure of the positioning part 12 of the holding body 10, or as other protruded structure for the display product 30 to attach thereon, or the positioning part 12 of the holding part 10 can be formed as a hollow sleeve-ring structure as the sleeving and covering part 21, for attaching a tool with both ends in protruded rod structures.

Note that the specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. A product packaging and displaying device comprising:

a holding body and a covering body;

said holding body including one side having a protruded hanging part for hanging purpose, another side having a plurality of protruded positioning parts for one end of a display product to engage thereon, and a connecting part for a sleeving and covering part to connect onto, said positioning parts being evenly disposed on said holding body, each said positioning part being formed by two parallel pieces, each said parallel piece having a locking device disposed on outer side for pressing against the display product, said connecting part having more than one positioning hole, a display part being protruded and disposed between said positioning part and said hanging part, a width of said display part being wider than the outer edges of said display product;

said covering body being connected and disposed on one side of said holding body, in which said display product is disposed on the same side, said covering body having said sleeving and covering part in corresponding to said positioning part, a hollow connecting board being disposed at each end of said covering body, said connecting board having a locking piece to lock with said positioning hole of said connecting part, for fixing said connecting part of said holding body, the outer diameter of said sleeving and covering part being wider than the width of the outer edges of said display product.

2. The product packaging and displaying device as claimed in claim 1, wherein said display part is hollow, with its two ends protruded outward.

3. The product packaging and displaying device as claimed in claim 1, wherein said sleeving and covering part of said covering body is formed as the same structure of said positioning part of said holding body for attaching products with holes, for placing and positioning said display product.

4. The product packaging and displaying device as claimed in claim 1, wherein said positioning part of the holding body is formed as a hollow sleeve-ring structure in corresponding to said sleeving and covering part, for attaching said display product having both ends in protruded rod structure.

5. A product packaging and displaying device comprising: a holding body and a covering body;

one side of said holding body having a hollow display part protruded outward, another side having a protruded positioning part for one end of a display product to attach thereon, and a connecting part for connecting to a sleeving and covering part, a width of said display part being wider than a maximum width of said display product, said sleeving and covering part being a ring-shaped structure for attaching on said display product;

said covering body being connected and disposed on one side of said holding body, in which said display product is disposed on the same side, said covering body having said sleeving and covering part in corresponding to said positioning part, a hollow connecting board being disposed at each end of said covering body, the outer diameter of said sleeving and covering part being wider than the width of the outer edges of said display product.

6. The product packaging and displaying device as claimed in claim 5, wherein said positioning parts are evenly disposed on said holding body, each said positioning part is formed by two parallel pieces, a width of two said parallel pieces equals to a hole diameter of said display product, each said parallel piece includes a locking device disposed on an outer side for pressing against the display product.

7. The product packaging and displaying device as claimed in claim 5, wherein said connecting part is disposed at each end of said holding body, more than one positioning hole are formed in said connecting part, a locking piece is protruded and disposed on said connecting board of said covering body, said locking piece locks with said positioning hole, for fixing said connecting part to said connecting board.

8. The product packaging and displaying device as claimed in claim 5, wherein said sleeving and covering part of said covering body is formed as the same structure of said positioning part of said holding body for attaching products with holes, for placing and positioning said display product.

* * * * *